US007544875B2

(12) United States Patent
Hsieh

(10) Patent No.: US 7,544,875 B2
(45) Date of Patent: Jun. 9, 2009

(54) ADJUSTING ASSEMBLY FOR A DRUM SUPPORT IN A MARCHING BAND

(75) Inventor: Wu-Hong Hsieh, Lu Chou (TW)

(73) Assignee: K. H. S. Musical Instrument Co., Ltd., Taipei Hsien (TW)

( * ) Notice: Subject to any disclaimer, the term of this patent is extended or adjusted under 35 U.S.C. 154(b) by 184 days.

(21) Appl. No.: 11/709,265

(22) Filed: Feb. 22, 2007

(65) Prior Publication Data

US 2008/0202316 A1 Aug. 28, 2008

(51) Int. Cl.
*G10D 13/02* (2006.01)

(52) U.S. Cl. ..... 84/421; 224/265

(58) Field of Classification Search ..... 84/421, 84/402; 224/265; D3/204
See application file for complete search history.

(56) References Cited

U.S. PATENT DOCUMENTS 4,387,839 A * 6/1983 Dranchak ..... 224/265
6,329,583 B1 * 12/2001 May ..... 84/421

* cited by examiner

*Primary Examiner*—Jianchun Qin
(74) *Attorney, Agent, or Firm*—Muncy, Geissler, Olds & Lowe, PLLC

(57) ABSTRACT

An adjusting assembly for a drum support includes multiple adjusting holes defined through the second extension of the secondary base and multiple fixing holes defined in the first extension of the primary base. One adjusting hole corresponds to and aligns with at least two fixing holes such that relative position of the second extension to the first extension is easily adjusted and secured via fixing bolts. An urging plate received in the seat and pushed by distal free ends of two threaded bolts is able to secure the hook inside the seat to provide a supporting force to the drum.

2 Claims, 6 Drawing Sheets

ADJUSTING ASSEMBLY FOR A DRUM SUPPORT IN A MARCHING BAND

BACKGROUND OF THE INVENTION

1. Field of the Invention

The present invention relates to an adjusting assembly, and more particularly to an adjusting assembly for a drum support in a marching band to allow the drum support to be easily adjusted to adapt to users of different height.

2. Description of the Prior Art

In a marching band, a drum is responsible for providing beats to the songs that are being played so that all the members in the band are able to follow the beats to perform formations. In order to allow the drummer to easily carry the drum around while the marching band is moving, a drum support is provided to allow the drummer to easily walk with the band. The drum support is provided with a pair of arcuate supports which are designed to be placed on top of the user's shoulders, a base assembly and a pair of hooks adjustably connected to the base assembly. The base assembly is composed of a primary base having a first extension vertically extending upward from the primary base and a secondary base having a second extension vertically extending downward from the secondary base. The first extension is provided with multiple fixing holes and the second extension is provided with multiple adjusting holes respectively aligned with the fixing holes. A fixing bolt is able to extend through the mutually aligned fixing holes and adjusting holes to securely secure engagement between the first extension and the second extension such that after the pair of arcuate supports are fixed to the secondary base and the hooks are fixed to the primary base, the drummer is able to pull out the fixing bolt to realign the fixing holes and the adjusting holes to adjust a relative position between the first extension and the second extension. Therefore, the drum support is adjusted to adapt to the height of the drummer.

During adjustment, it is noted that a specific fixing hole is corresponding to and aligned with a specific adjusting hole so that the drummer may sometimes need to cope with the limited adjustment capability of the current drum support. That is, due to the limited adjustment capability, the drummer may not be able to adjust the relative position between the first extension and the second extension of the drum support to a specific condition and the drummer may need to play along in spite of the bad adjustment result.

To overcome the shortcomings, the present invention tends to provide an improved adjusting assembly to mitigate the aforementioned problems.

SUMMARY OF THE INVENTION

The primary objective of the present invention is to provide an improved adjusting assembly for a drum support, wherein the adjusting assembly includes elongated adjusting holes defined in the second extension of the secondary base and multiple fixing holes defined in the first extension of the primary base. Each elongated adjusting hole corresponds to and aligns with at least two fixing holes of the first extension. When a fixing bolt extends through one of the fixing holes, the additional space in each of the adjusting holes allows the drummer to adjust the relative position of the secondary base to the primary base to a position where the drummer feels most comfortable.

Another objective of the present invention is that a sleeve is inserted into a respective one of positioning holes in the seat which is integrally formed on a side of the primary base and a threaded bolt is threadingly extended through the sleeve and into the seat. After an urging plate is placed inside the seat, the distal end of the threaded bolt extending into the seat urges against and forces the urging plate to move toward the hook that is inserted into the seat. Due to the engagement between the urging plate and the hook, the holding force to the hook is emphasized and the integrity of the hook is protected.

Other objects, advantages and novel features of the invention will become more apparent from the following detailed description when taken in conjunction with the accompanying drawings.

DETAILED DESCRIPTION OF THE PREFERRED EMBODIMENT

Figure 1:
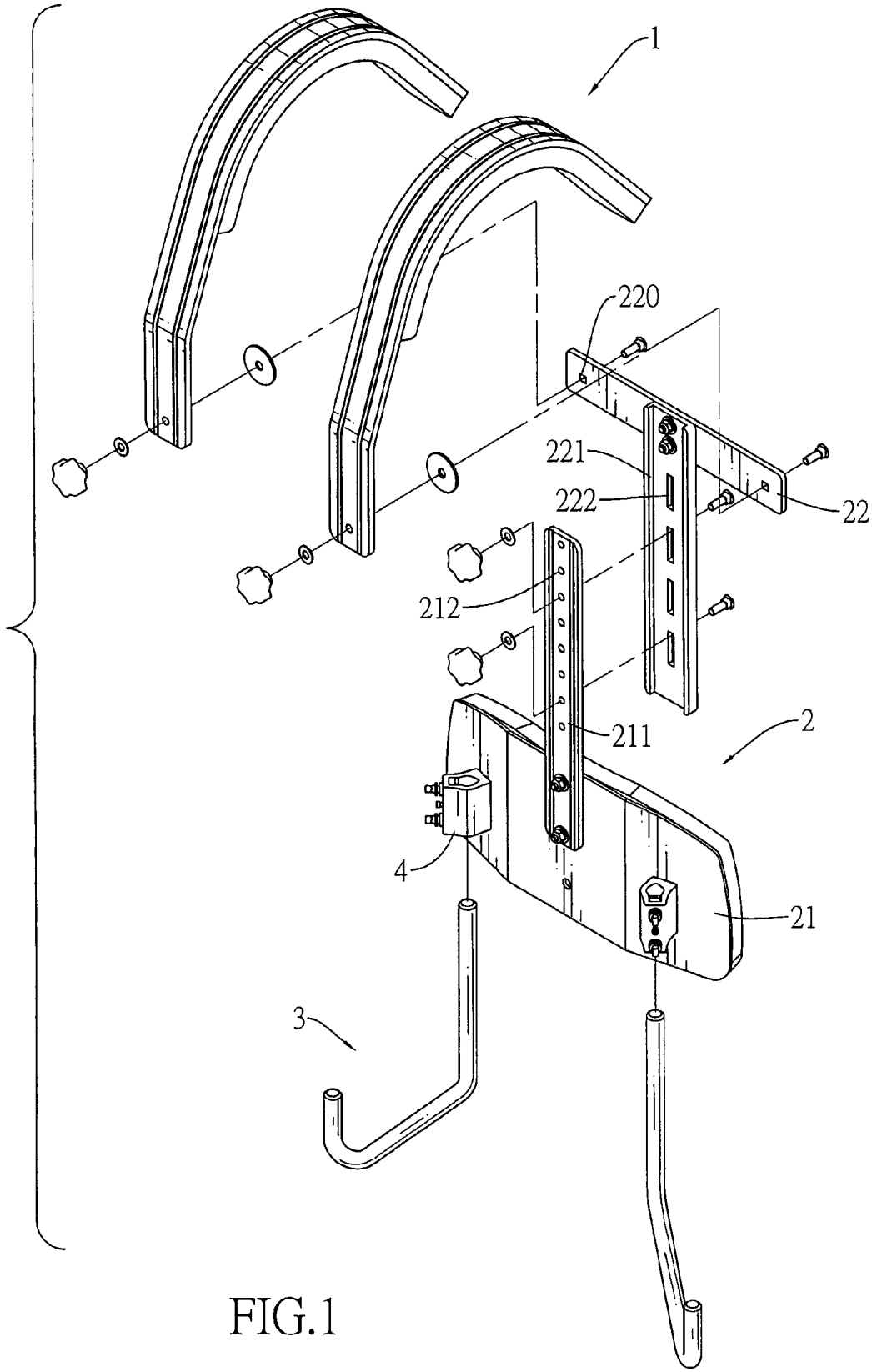
FIG. 1 is an exploded perspective view of a portion of the adjusting assembly of the present invention used to adjust relative position of the secondary base to the primary base.
Figure 2:
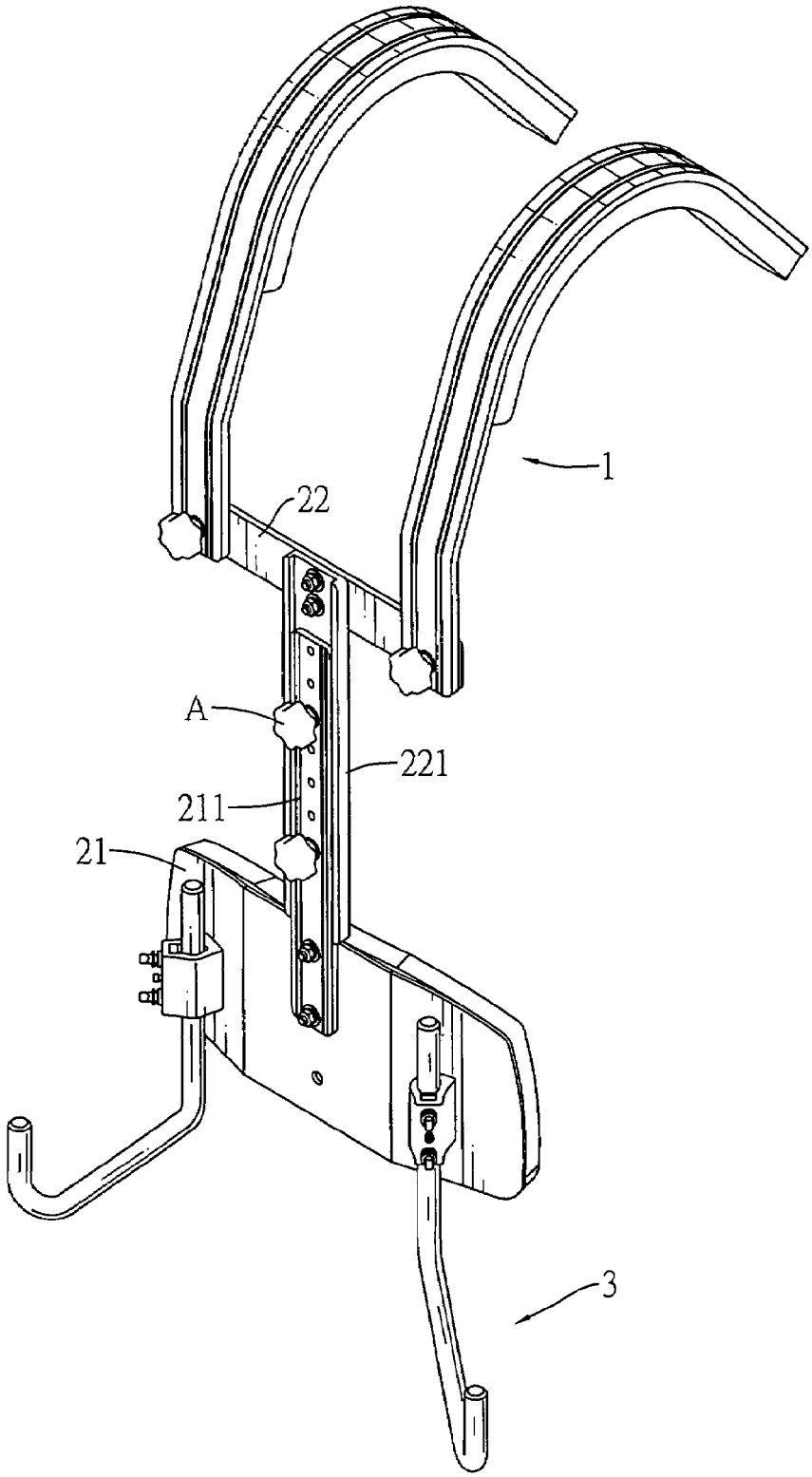
FIG. 2 is a perspective view showing that the second extension is connected to the first extension.
Figure 3:
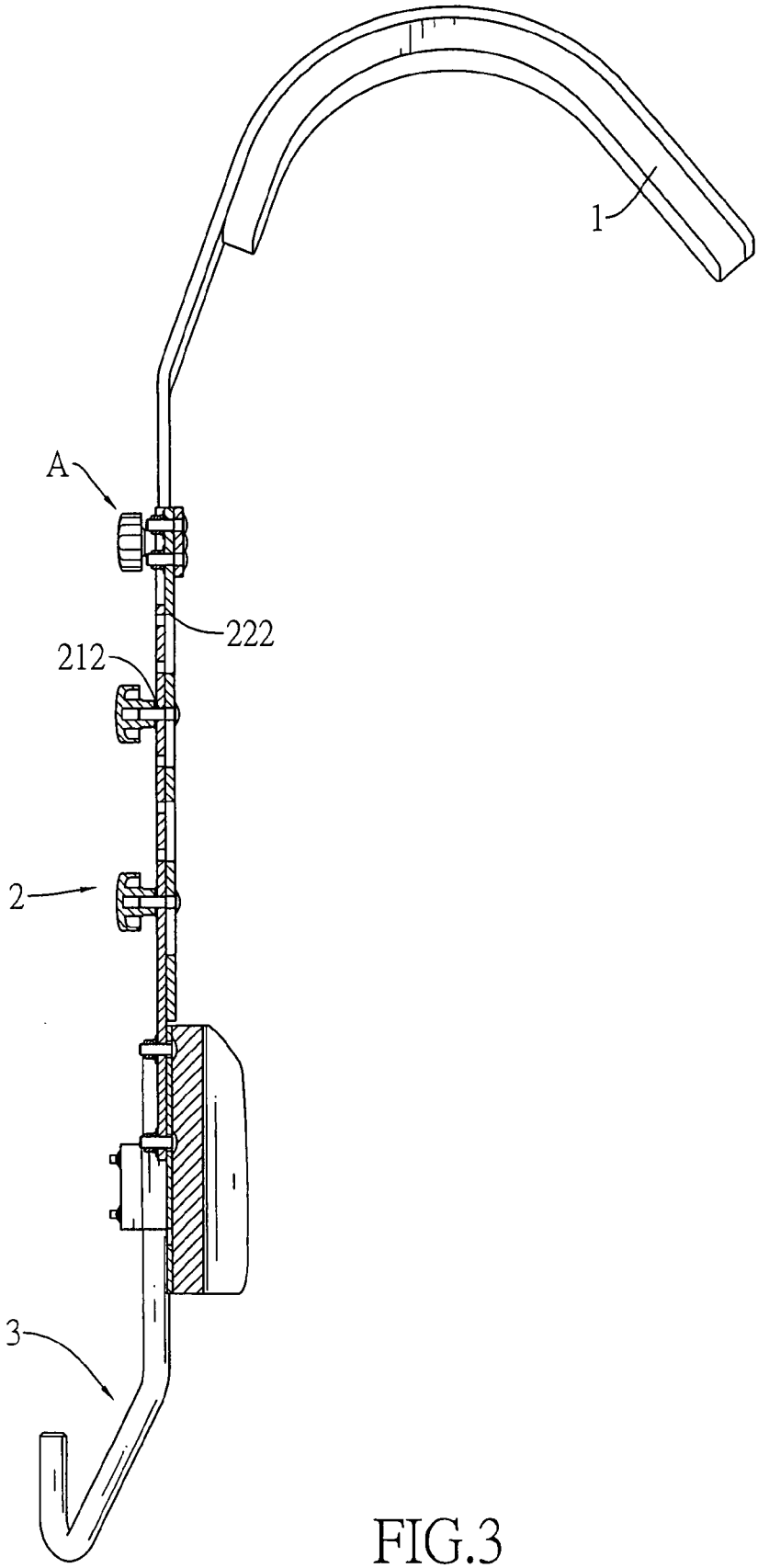
FIG. 3 is a side plan view with partially cross sectioned to show the relative position between the second extension and the first extension.

With reference to FIGS. 1, 2 and 3, it is noted that the adjusting assembly in accordance with the present invention is used for a drum support having a pair of arcuate supports (1), a base assembly (2) and a pair of hooks (3) adjustably connected to the base assembly (2). The arcuate supports (1) are pivotally connected to two ends of the base assembly (2) and rested on the drummer's shoulders. The purpose of the arcuate supports (1) is aimed at providing a supporting force to the weight of the base assembly (2), the hooks (3) and the drum (not shown) which is supported by the pair of hooks (3). Because the pivotal connection of the arcuate supports (1) to the base assembly (2) and how the hooks (3) are used to support the drum are not the focus of the present invention, the operation and structural relationship among the parts are omitted. The following description will be focused on the function and impact of the adjusting assembly to the drum support.

Before the introduction of the adjusting assembly of the present invention, it is first noted that the base assembly (2) is composed of a primary base (21) and a secondary base (22). The primary base (21) has a first extension (211) extending vertically upright relative to the primary base (21) and having multiple fixing holes (212) defined through the first extension (211). The secondary base (22) has a pair of connection holes (220) each defined in an end thereof for a pivotal connection to one of the two arcuate supports (1) and a second extension (221) extending vertically downward relative to the secondary base (22). Basically the description above is substantially the same as that of a conventional drum support.

In order to improve the adjusting capability between the secondary base (22) and the primary base (21), the second extension (221) has multiple adjusting holes (222) defined through the secondary extension (221). Each adjusting hole (222) corresponds to and aligns with at least two (only two are shown in this embodiment) fixing holes (212). Therefore, with the additional space in each of the adjusting holes (222), the drummer is able to easily adjust the relative position of the secondary base (22) to the primary base (21) to a position where the drummer feels most comfortable. That is, the drummer is able to use the extra space in each of the adjusting holes (222) to easily align with a specific fixing hole (212). Thereafter, at least two fixing bolts (A) are employed to extend through the aligned fixing hole (212) and the adjusting hole (222) and engagement between the first extension (211) and the second extension (221) is secured. During the conventional alignment between the fixing hole and the adjusting holes respectively in the first extension and the second extension of the conventional drum support, the drummer will have to precisely align one specific fixing hole with one specific adjusting hole to complete the adjustment of the relative position of the secondary base to the primary base. With the additional space in each of the adjusting holes (222) of the present invention, the drummer may complete the adjustment of the relative position of the secondary base (22) to the primary base (21) rather easily.

Figure 4:
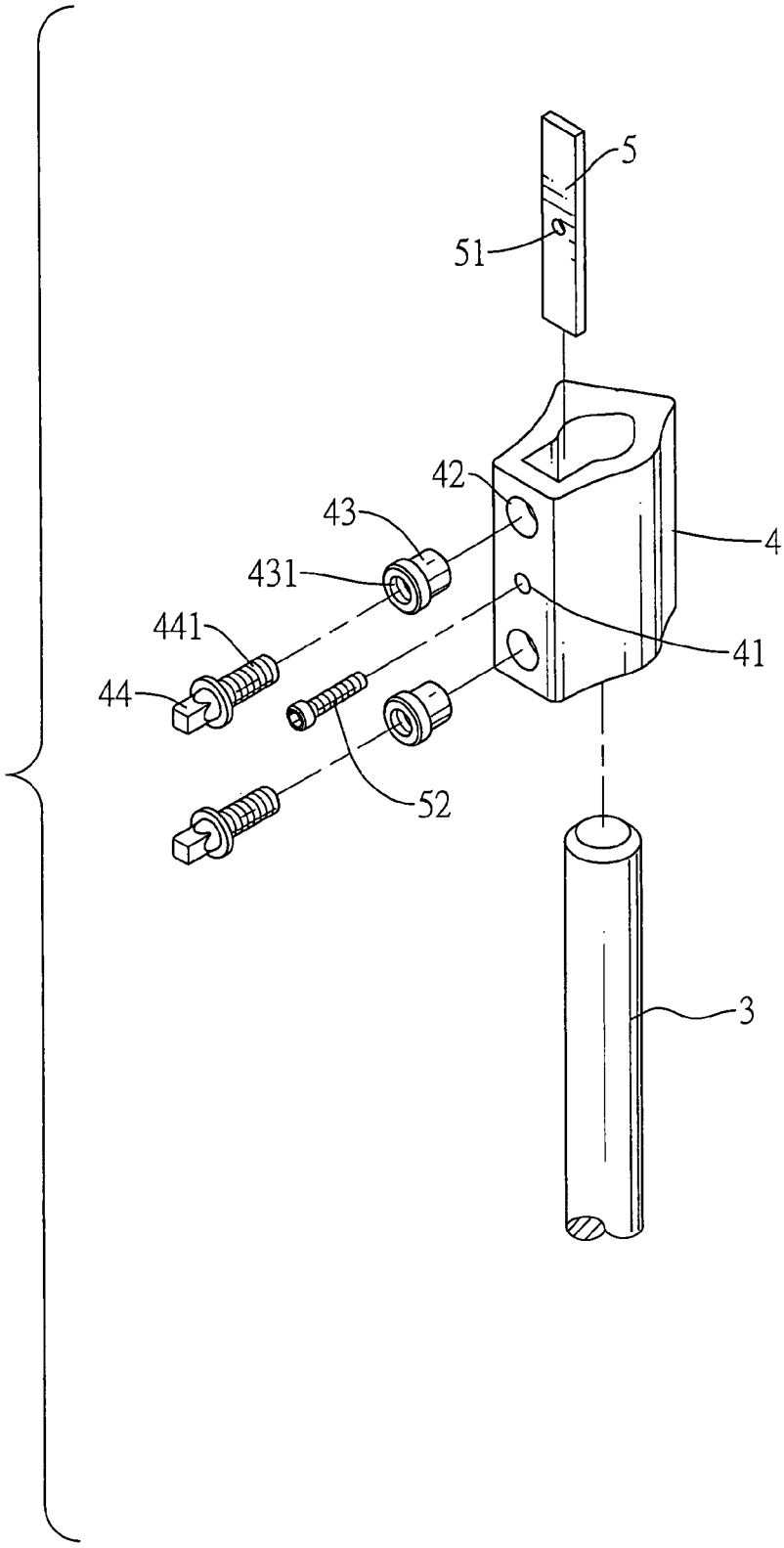
FIG. 4 is an exploded perspective view of a different portion of the adjusting assembly of the present invention.
Figure 5:
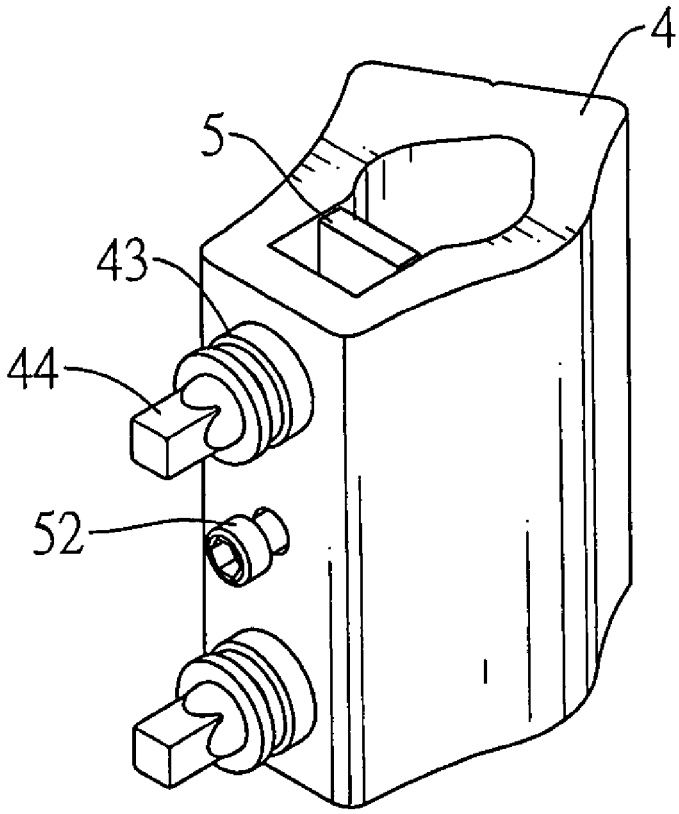
FIG. 5 is a perspective view showing that the portion of the adjusting assembly is assembled.
Figure 6:
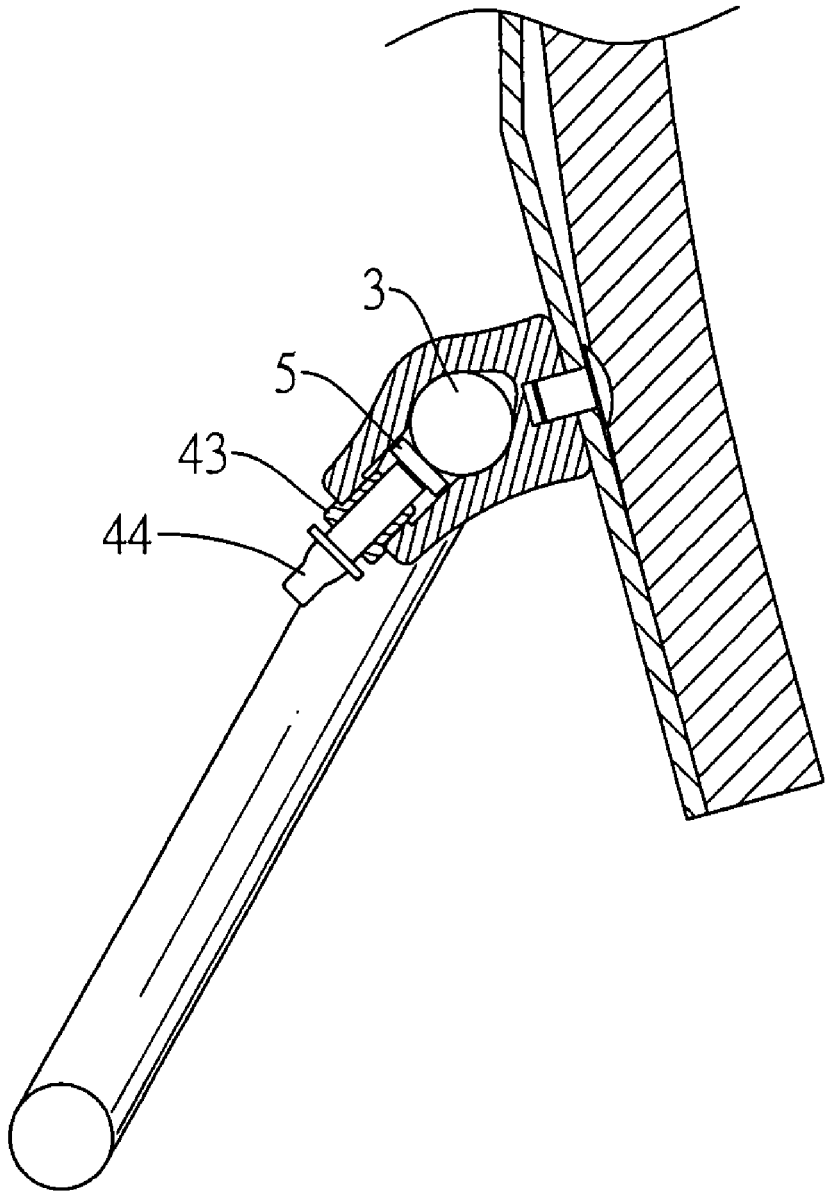
FIG. 6 is a schematic side plan view showing a portion of the adjusting assembly is in cross section to demonstrate how the hook is retained inside the seat.

With reference to FIGS. 4, 5 and 6, it is noted that on a side face of the primary base (21), two seats (4) are respectively mounted thereon. Each seat (4) is hollow inside and has a top opening and a bottom opening respectively communicating with an interior of the seat (4). Each seat (4) has a through hole (41) defined through a side face thereof to communicate with the interior of the seat (4), two holes (42) separated from each other via the through hole (41) and defined to communicate with the interior of the seat (4). Two sleeves (43) each having an inner threading (431) formed therein are securely received in a corresponding one of the two holes (42). Two threaded bolts (44) each having an outer threading (441) are threadingly extended into a corresponding one of the sleeves (43). An urging plate (5) having a centrally defined aperture (51) is inserted into the seat (4) from the top opening of the seat (4). A positioning pin (52) is extended through the through hole (41) and into the aperture (51) of the urging plate (5) so as to position the urging plate (5) inside the seat (4).

After the urging plate (5) is positioned inside the seat (4) via the positioning pin (52) and a distal end of the hook (3) is inserted into the seat (4) from the bottom opening of the seat (4), extension of the two threaded bolts (44) through the two sleeves (43) allows distal free ends of the two threaded bolts (44) to abut a side face of the urging plate (5) to move closer to the distal end of the hook (3). Eventually, the distal end of the hook (3) is securely held in position inside the seat (4). Then the drummer is able to use proximal ends of the two hooks (3) to support the drum.

Due to the engagement between the urging plate (5) and an outer periphery of a corresponding distal end of the hook (3) being a line engagement, the integrity of the outer periphery of the distal end of the hook (3) is maintained without any damage. In the conventional method to secure the distal end of the hook (3), the outer periphery of the hook (3) is damaged by the threaded bolts because the distal ends of the threaded bolts are in direct contact with the outer periphery of the hook. Therefore, with the provision of the urging plate (5), the outer periphery of the hook (3) is intact.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. In a drum support having a base assembly, a pair of arcuate supports pivotally connected to the base assembly and a pair of hooks adjustably connected to the base assembly, wherein the improvement comprises:

the base assembly is composed of a primary base with a first extension vertically extending upright relative to the primary base and having multiple fixing holes defined through the first extension and a secondary base with a second extension vertically extending downward relative to the secondary base and having multiple adjusting holes defined through the second extension, wherein one adjusting hole corresponds to and aligns with at least two fixing holes such that relative position of the second extension to the first extension is easily adjusted and secured via fixing bolts; and wherein two hollow seats are adapted to be securely mounted on a side of the primary base, each seat has a top opening, a bottom opening, and two holes, two sleeves each having therein an inner threading are respectively inserted into a corresponding one of the two holes and two threaded bolts each having an outer threading are respectively extended through a corresponding one of the two sleeves and into the seat to abut an urging plate which is received inside the seat so that a distal end of the hook that is received in the seat is in engagement with and pushed by the urging plate to position the hook inside the seat.

2. The drum support as claimed in claim 1, wherein the urging plate has a centrally defined aperture aligning with a through hole of the seat such that a positioning pin extending through the through hole of the seat and into the aperture of the urging plate is able to position the urging plate inside the seat.

* * * * *